United States Patent [19]

Panzarella

[11] 4,381,620

[45] May 3, 1983

[54] ACTION DEVICE WITH CONFINED ACTION ELEMENT

[75] Inventor: James S. Panzarella, East Aurora, N.Y.

[73] Assignee: The Quaker Oats Company, Chicago, Ill.

[21] Appl. No.: 325,353

[22] Filed: Nov. 27, 1981

[51] Int. Cl.[3] ..... A63H 1/32

[52] U.S. Cl. ..... 46/47; 46/32; 273/58 F

[58] Field of Search ..... 46/47, 49, 50, 201, 46/269, 99, 100, 209, 32, 1 R, 53, 56, 48, 61-63; 272/8 R, 8 N; 273/58 B, 58 F

[56] References Cited

U.S. PATENT DOCUMENTS

| | | | |
|---|---|---|---|
| 617,665 | 1/1899 | Waterhouse | 46/50 |
| 1,077,340 | 11/1913 | Graham | 46/47 |
| 2,189,853 | 2/1940 | Zadek | 46/32 |
| 2,473,574 | 6/1949 | Davis | 46/201 X |
| 2,519,248 | 8/1950 | Hulbert | 46/100 |
| 3,058,261 | 10/1962 | Lakin | 46/99 |

*Primary Examiner*—Mickey Yu

*Attorney, Agent, or Firm*—Cumpston & Shaw

[57] ABSTRACT

A toy having a spherical hollow ball rotatably supported on a stand by two stub shafts molded on the ball. An action element mounted on a spindle is located within the ball for limited movement by two parallel apertured baffle plates. The spindle has a length slightly less than the diameter of the ball. Each end of the spindle is beveled and is in contact with the interior surface of the ball whereby as the ball is rotated the spindle and the action element is caused to rotate within the confines of the apertures of the baffle plates. The stand is supported by a resilient neck and a suction cup base.

7 Claims, 2 Drawing Figures

ACTION DEVICE WITH CONFINED ACTION ELEMENT

BACKGROUND OF THE INVENTION

1. Field of the Invention

The present invention relates generally to action devices. More particularly, the invention is concerned with an action device in which the action element thereof is confined primarily to a spinning and limited rocking motion.

2. Description of the Prior Art

U.S. Pat. No. 3,058,261 discloses a rotatable hollow ball action toy within which an action element floats freely, and rocks, spins or tumbles in response to rolling of the ball.

A rotatable hollow ball action toy is further known in the art comprising diametrically opposed parallel, coaxial rings secured to the inner periphery of the ball. An action element mounted within the ball has a spindle, the opposite ends of which have cylindrical bearings which constantly bear against the inner surfaces of the rings under the influence of gravity, and rotate on the inner surfaces upon rotation of the ball.

SUMMARY OF THE INVENTION

In accordance with a preferred embodiment of the invention, a rotatable hollow ball action device is disclosed in which an action element loosely mounted therein is confined primarily to a spinning and limited rocking motion.

Briefly, the hollow ball action device comprises an action element having a spindle of a length slightly less than the diameter of the inner peripheral surface of the ball. End portions of the spindle bear upon and are in rolling engagement with diametrically opposed predetermined portions only of the inner peripheral surface. Means are provided on the inner surface for confining movement of the spindle end portions to the predetermined portions of the inner surface. Accordingly, upon rotation of the ball preferably about a fixed spherical axis, primarily spinning and limited rocking motion is imparted to the action element.

In a further aspect of the invention, the movement confining means comprises parallel, spaced apart baffle plates secured to diametrically opposed regions of the inner peripheral surface. The plates have coaxial openings defining circular shoulders which are engageable by, and limit the extent of movement of, the end portions of the spindles.

In a more specific aspect of the invention, means are provided for rotatably supporting the ball about a spherical axis extending through centers of the predetermined portions of the inner peripheral surface, and at right angles to the baffle plates. The ball supporting means in one embodiment comprises a stand having a U-shaped member at one end for rotatably supporting the ball. A suction cup at the other end of the stand releasably secures the stand to a support base. By providing a resilient neck on the suction cup, the stand is swingable relative to the base.

One of the primary advantages of the present invention is to provide a rotatable hollow ball action device in which optimum spinning and limited rocking motion of the action element is obtained at all times. This is achieved by confining movement of horizontally oriented end portions of the action element to diametrically opposed predetermined portions only of the inner peripheral surface of the ball. Where the spindle and end portions thereof float within the ball and freely assume any cross-wise or transverse position therein, the action element will stop spinning and provide little action in those instances in which it assumes a substantially vertical planar position.

The invention and its advantages will become more apparent from the detailed description of the invention presented below.

BRIEF DESCRIPTION OF THE DRAWINGS

The details of the invention will be described in connection with the accompanying drawings, in which.

DETAILED DESCRIPTION OF THE INVENTION

Figure 1:
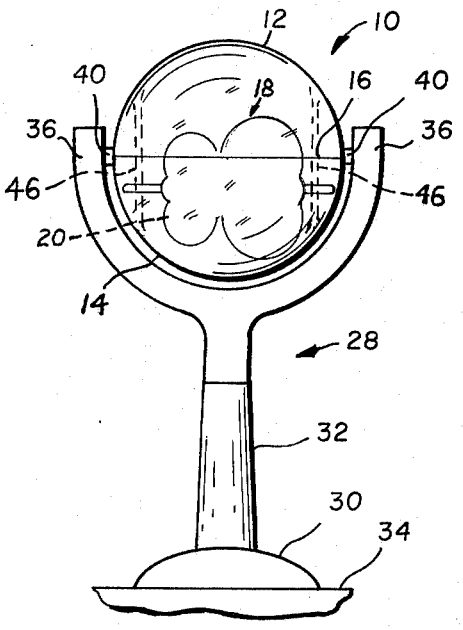
FIG. 1 is a side elevational view of the action device of this invention.
Figure 2:
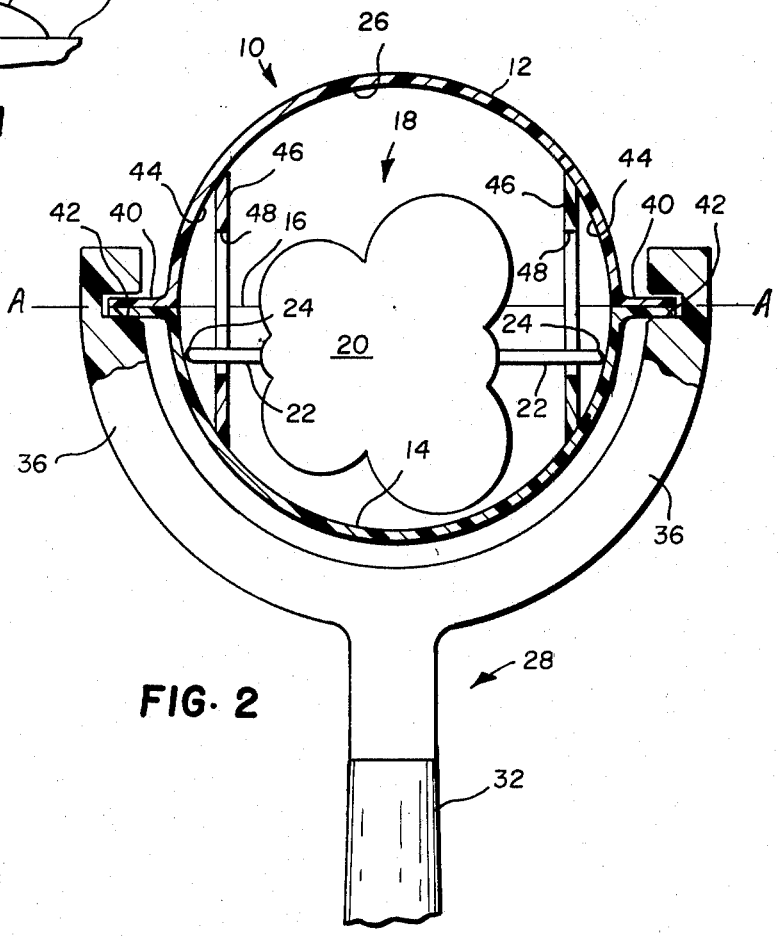
FIG. 2 is an enlarged segmental view in section taken substantially through the center of the ball of the action device of FIG. 1.

With reference to FIGS. 1 and 2, a preferred embodiment of the action device of this invetion is disclosed comprising a transparent spherical hollow ball 10. The ball is preferably formed by joining two semi-spherical ball havles 12, 14 together along an equatorial seam line 16 with cement or the like. The ball halves 12, 14 are formed by any suitable molding or stamping operation utilizing any suitable plastic material, such as cellulose acetate, for example, that is transparent and has high impact strength.

An action element 18, also formed from any suitable plastic material, is mounted within the ball. Action element 18 comprises a unitary member preferably formed by a single molding or casting operation. The action element has a central preferably colorful figure 20 of any suitable outer shape of configuration, such as a butterfly or the like, that is symmetrical relative to coaxial spindles 22. The spindles are preferably beveled at the free ends 24 thereof, and the distance between the spindle ends is slightly less than the diameter of the ball. Accordingly, when action element 18 is placed within ball 10 in a horizontal orientation, spindle ends 24 will engage the inner surface 26 of the ball at a level below the horizontally oriented equator of the ball. In this position, rotation of the ball about a horizontal axis parallel to spindles 22, in combination with gravity acting on the action element, will cause the moving inner surface 26 of the ball to impart a maximum spinning motion to the spindles 22 and action element 18. As the spindles assume a limited transverse position relative to the axis of rotation of the ball, the moving inner surface 26 imparts a combined spinning and limited rocking action to the action element. In contrast, unconfined spindles in action devices may assume a position at right angles to the axis of rotation causing tumbling motion to be imparted to action element 18. Such tumbling motion is normally not as attractive and interesting to observers as the spinning and rocking motion.

A stand 28 is provided for rotatably supporting the spherical ball 10 about a fixed spherical axis A—A, as seen in FIG. 2. One end of stand 28 has a suction cup 30 secured thereto by any suitable means. Suction cup 30 has a resilient neck 32 to allow swinging movement of the stand relative to a support base 34, such as a desk top, to which the suction cup can be secured by suction. The opposite end of the stand 28 is U-shaped, forming a pair of spaced arms 36 having aligned slots 42, as seen in FIG. 2. Ball 10 has a pair of aligned cylindrical stub shafts 40 preferably integrally molded with the ball halves 12, 14. The stub shafts 40 are rotatably mounted within slots 42 for rotation about axis A—A.

With reference to FIG. 2, means are disclosed for confining the spindle ends 24 to a predetermined area or region 44 of the inner periphery of the ball 10 for maximizing the spinning motion, limiting the rocking motion and eliminating the tumbling motion of the action element. The confining means comprises a pair of spaced apart, parallel baffle plates 46 lying in chordal planes perpendicular to the axis of rotation of the ball. The plates 46 are affixed to the inner surface 26 of the ball, and have central aligned circular openings defining circular shoulders 48. The shoulders are engageable by the spindles 22 for limiting the transverse angular movement of the action element 18 about its axis of rotation to a maximum of about 30 degrees relative to the axis of rotation of the ball. This effectively confines the spindle ends 22 to movement within the predetermined circular inner peripheral regions 44 of the ball having, for example, diameters of around 1 inch (2.54 cm). Accordingly, when the ball 10 is swung and/or rotated on the stand about its axis of rotation, a vigorous spinning motion is imparted to the action element, along with possibly a slight angular rocking motion at times, resulting in a pleasing, interesting, attractive and entertaining action device or toy for children as well as adults.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A rotatable hollow ball action device comprising:

a hollow transparent ball having an inner peripheral surface;

an action element having a spindle of a length slightly less than the diameter of said inner peripheral surface, said spindle having end portions thereof bearing upon and in rolling engagement with diametrically opposed predetermined portions only of said inner peripheral surface; and means on said inner peripheral surface for confining movement of each of said spindle end portions to said predetermined portions whereby primarily spinning and limited rocking motion is imparted to said action element upon rotation of said ball.

2. A rotatable hollow ball action device according to claim 1 wherein said action element comprises a unitary molded figure.

3. A rotatable hollow ball action device according to claims 1 or 2 wherein said movement confining means comprises parallel, spaced apart baffle plates secured to diametrically opposed chordal regions of said inner peripheral surface, said plates further having coaxial openings defining circular shoulders which are normally disengaged from said end portions of said spindle, and are engageable by said end portions only to confine movement of said spindle to said predetermined portions of said inner peripheral surface.

4. A rotatable hollow ball action device according to claim 1, and further comprising means for rotatably supporting said ball for rotation about a spherical axis extending through the centers of said predetermined portions of said inner peripheral surface.

5. A rotatable hollow ball action device according to claim 4 wherein said ball has axially extending stub shafts, and said ball supporting means comprises a stand having a U-shaped member at one end thereof, and means at the free ends of said U-shaped member for rotatably supporting said stub shafts for rotation about said spherical axis.

6. A rotatable hollow ball action device according to claim 5 wherein a suction cup is provided at the opposite end of said stand for releasably securing said stand to a support base.

7. A rotatable hollow ball action device according to claim 6 wherein said suction cup has a resilient neck to allow swinging movement of said stand relative to the support base.

* * * * *